US010082745B2

(12) United States Patent
Sumioka

(10) Patent No.: US 10,082,745 B2
(45) **Date of Patent: *Sep. 25, 2018**

(54) ELECTROSTATIC LATENT IMAGE DEVELOPING TONER

(71) Applicant: KYOCERA Document Solutions Inc., Osaka (JP)

(72) Inventor: Sho Sumioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/630,486

(22) Filed: Jun. 22, 2017

(65) Prior Publication Data

US 2017/0371258 A1 Dec. 28, 2017

(30) Foreign Application Priority Data

Jun. 28, 2016 (JP) ..... 2016-127680

(51) Int. Cl.
*G03G 9/08* (2006.01)
*G03G 9/093* (2006.01)

(52) U.S. Cl.
CPC ..... *G03G 9/09321* (2013.01); *G03G 9/09307* (2013.01); *G03G 9/09314* (2013.01); *G03G 9/09364* (2013.01); *G03G 9/09371* (2013.01); *G03G 9/09392* (2013.01)

(58) Field of Classification Search
CPC ..... G03G 9/09307; G03G 9/09314; G03G 9/09321; G03G 9/09371; G03G 9/09392
USPC ..... 430/110.2
See application file for complete search history.

(56) References Cited

U.S. PATENT DOCUMENTS

2005/0271964 A1 12/2005 Etou et al.

FOREIGN PATENT DOCUMENTS

JP 2004-294469 A 10/2004

*Primary Examiner* — Mark A Chapman
(74) *Attorney, Agent, or Firm* — Studebaker & Brackett PC

(57) ABSTRACT

An electrostatic latent image developing toner includes toner particles each including a core and a shell layer. The shell layer is a collection of resin particles having the same composition (primary particle diameter of at least 90% by number of the resin particles: 20 nm-30 nm). The shell layer includes a first shell layer, which is a film including the resin particles in a non-aggregated state, and a second shell layer, which is a plurality of particle aggregates (secondary particle diameter of at least 90% by number of the particle aggregates: 100 nm-150 nm). The particle aggregates each include the resin particles in an aggregated state. The surface of the core is entirely covered with the shell layer. The second shell layer is present in a surface of the toner particle in a proportion of at least 5% by area and no greater than 15% by area.

9 Claims, 3 Drawing Sheets

ELECTROSTATIC LATENT IMAGE DEVELOPING TONER

INCORPORATION BY REFERENCE

The present application claims priority under 35 U.S.C. § 119 to Japanese Patent Application No. 2016-127680, filed on Jun. 28, 2016. The contents of this application are incorporated herein by reference in their entirety.

BACKGROUND

The present disclosure relates to an electrostatic latent image developing toner, and more particularly, to a capsule toner.

A known capsule toner includes a plurality of toner particles each including a core and a shell layer (capsule layer) covering a surface of the core. The shell layers covering the cores of the toner particles can improve high-temperature preservability of the toner.

SUMMARY

An electrostatic latent image developing toner according to an aspect of the present disclosure includes a plurality of toner particles each including a core and a shell layer covering a surface of the core. The shell layer is a collection of a plurality of resin particles having the same composition. At least 90% by number of the resin particles in the shell layer each have a primary particle diameter of at least 20 nm and no greater than 30 nm. The shell layer includes a first shell layer and a second shell layer. The first shell layer is a film including the resin particles in a non-aggregated state. The second shell layer is a plurality of particle aggregates. The particle aggregates each include the resin particles in an aggregated state. At least 90% by number of the particle aggregates in the second shell layer each have a secondary particle diameter of at least 100 nm and no greater than 150 nm. The surface of the core is entirely covered with the shell layer. The second shell layer is present in a surface of the toner particle in a proportion of at least 5% by area and no greater than 15% by area.

DETAILED DESCRIPTION

Figure 1:
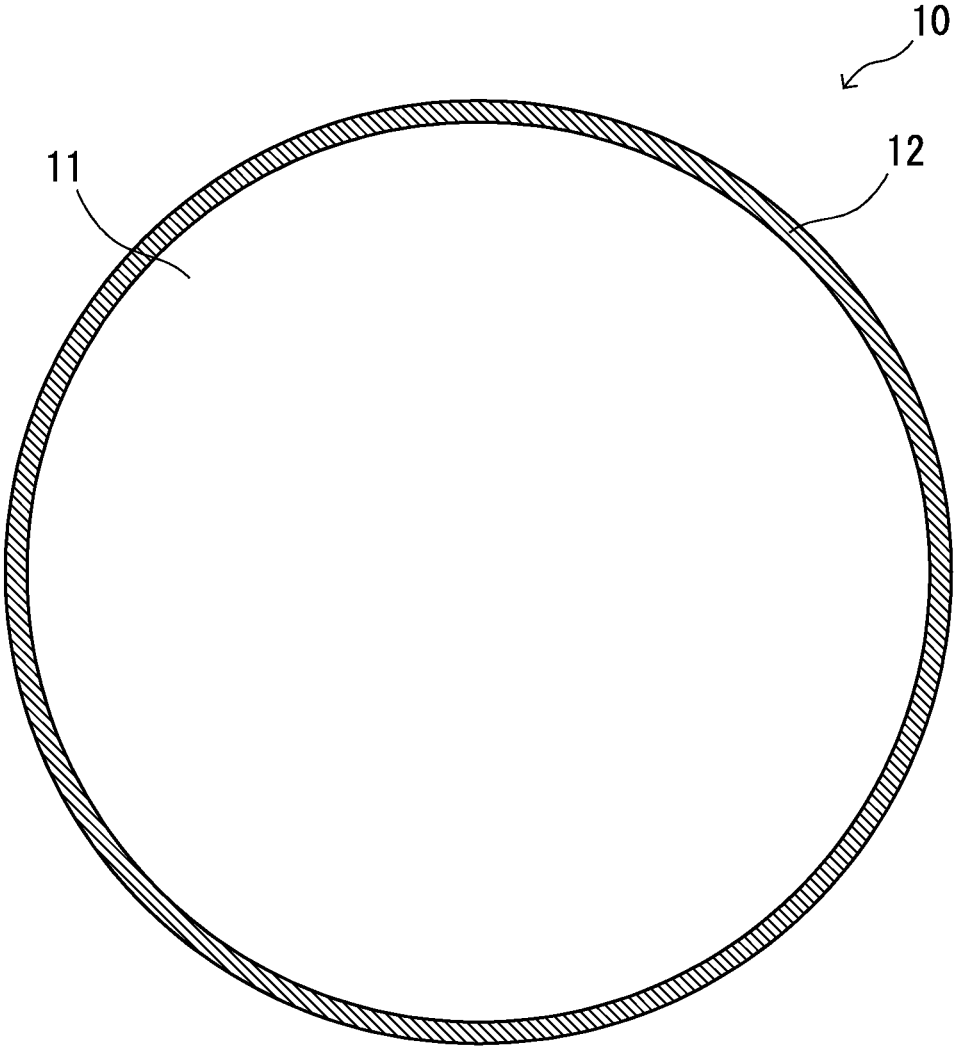
FIG. 1 is a diagram illustrating an example of a cross-section structure of a toner particle (particularly a toner mother particle) included in an electrostatic latent image developing toner according to an embodiment of the present disclosure.

The following describes an embodiment of the present disclosure in detail. Note that unless otherwise stated, results (for example, values indicating shapes or properties) of evaluations that are performed on a powder (specific examples include toner cores, toner mother particles, an external additive, or a toner) are number averages of measurements made with respect to an appropriate number of particles.

A number average particle diameter of a powder is a number average of diameters of representative circles of primary particles (i.e., diameters of circles having the same area as projections of the particles) measured using a microscope, unless otherwise stated. A value for volume median diameter ($D_{50}$) of a powder is measured using a laser diffraction/light scattering-type particle size distribution analyzer ("LA-750", product of HORIBA, Ltd.), unless otherwise stated. A value for roundness (=perimeter of a circle having the same area as a projection of the particle/perimeter of the real particle) is a number average of values measured for a suitable number of particles (for example, 3,000 particles) using a flow particle imaging analyzer ("FPIA (registered Japanese trademark)-3000", product of Sysmex Corporation), unless otherwise stated. Acid values and hydroxyl values are measured in accordance with Japanese Industrial Standard (JIS) K0070-1992, unless otherwise stated. Values for number average molecular weight (Mn) and mass average molecular weight (Mw) are measured by gel permeation chromatography, unless otherwise stated.

Values for glass transition point (Tg) are measured in accordance with Japanese Industrial Standard (JIS) K7121-2012 using a differential scanning calorimeter ("DSC-6220", product of Seiko Instruments Inc.), unless otherwise stated. Glass transition point (Tg) of a sample is equivalent to a point of change in specific heat (onset temperature) on a heat absorption curve (vertical axis: heat flow (DSC signal), horizontal axis: temperature) (i.e., an intersection point of an extrapolation of the base line and an extrapolation of the inclined portion of the curve) of the sample from the second heat cycle that is performed using a differential scanning calorimeter. Values for softening point (Tm) are measured using a capillary rheometer ("CFT-500D", product of Shimadzu Corporation), unless otherwise stated. Softening point (Tm) is equivalent to a temperature along an S-shaped curve (horizontal axis: temperature, vertical axis: stroke) at which the stroke value is "(base line stroke value+maximum stroke value)/2". The S-shaped curve is plotted using the capillary rheometer.

Note that in the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. The term "(meth)acryl" is used as a generic term for both acryl and methacryl. The term "(meth)acryloyl" is used as a generic term for both acryloyl ($CH_2{=}CH{-}CO{-}$) and methacryloyl ($CH_2{=}C(CH_3){-}CO{-}$).

Strength of chargeability is equivalent to ease of triboelectric charging, unless otherwise stated. A toner can for example be triboelectrically charged by mixing and stirring the toner with a standard carrier (anionic standard carrier: N-01, cationic standard carrier: P-01) provided by The Imaging Society of Japan. Surface potential of a toner particle is measured before and after the triboelectric charging using for example a KFM (kelvin probe force microscope). A portion having a larger change in charge potential before and after the triboelectric charging has stronger chargeability.

The toner according to the present embodiment can for example be favorably used as a positively chargeable toner for development of an electrostatic latent image. The toner according to the present embodiment is a powder including a plurality of toner particles (particles each having a structure described below). The toner may be used as a one-component developer. The toner may also be mixed with a carrier using a mixing device (specific examples include a ball mill) and used as a two-component developer. In order to achieve high quality image formation, a ferrite carrier (a powder of ferrite particles) is preferably used as the carrier. In order to achieve high quality image formation over an extended period of time, magnetic carrier particles including carrier cores and resin layers coating the carrier cores are preferably used. In order that carrier particles are magnetic, carrier cores thereof may be formed from a magnetic material (for example, ferrite) or formed from a resin in which magnetic particles are dispersed. Alternatively, magnetic particles may be dispersed in resin layers coating carrier cores. Preferably, an amount of the toner in the two-component developer is at least 5 parts by mass and no greater than 15 parts by mass relative to 100 parts by mass of the carrier in order to achieve high quality image formation. Note that a positively chargeable toner included in a two-component developer is positively charged by friction against a carrier in the two-component developer.

The toner particles included in the toner according to the present embodiment each include a core (referred to below as a toner core) and a shell layer (capsule layer) covering a surface of the toner core. The toner cores contain a binder resin. The toner cores may contain an internal additive (for example, at least one of a colorant, a releasing agent, a charge control agent, and a magnetic powder). The shell layers (or the toner cores without the shell layers) may have an external additive adhering to surfaces thereof. The external additive may be omitted if unnecessary. In the present description, the term toner mother particles is used to refer to toner particles prior to adhesion of an external additive. Materials for forming the toner cores are referred to as toner core materials. Materials for forming the shell layers are referred to as shell materials.

The toner according to the present embodiment can for example be used in image formation in an electrophotographic apparatus (image forming apparatus). The following describes an example of image forming methods that are performed by electrophotographic apparatuses.

First, an image forming section (for example, a charger and a light exposure device) of an electrophotographic apparatus forms an electrostatic latent image on a photosensitive member (for example, on a surface of a photosensitive drum) based on image data. Next, a developing device (more specifically, a developing device having a toner-containing developer loaded therein) of the electrophotographic apparatus supplies the toner to the photosensitive member to develop the electrostatic latent image formed on the photosensitive member. The toner is charged by friction with the carrier in the developing device, a development sleeve, or a blade before being supplied to the photosensitive member. For example, a positively chargeable toner is positively charged. In the developing step, the toner (more specifically, the charged toner) on the development sleeve (for example, a surface of a development roller in the developing device) disposed in the vicinity of the photosensitive member is supplied to the photosensitive member and caused to adhere to the electrostatic latent image on the photosensitive member, so that a toner image is formed on the photosensitive member. Toner is supplied to the developing device from a toner container containing toner for replenishment use to make up for consumed toner.

Subsequently, in a transfer step, a transfer device of the electrophotographic apparatus transfers the toner image on the photosensitive member onto an intermediate transfer member (for example, a transfer belt), and then further transfers the toner image from the intermediate transfer member onto a recording medium (for example, paper). Next, a fixing device (fixing method: nip fixing in which fixing is performed through a nip between a heating roller and a pressure roller) of the electrophotographic apparatus fixes the toner to the recording medium by applying heat and pressure to the toner. Through the above, an image is formed on the recording medium. A full-color image can for example be formed by superimposing toner images of four different colors: black, yellow, magenta, and cyan. A direct transfer process may alternatively be employed, which involves direct transfer of the toner image on the photosensitive member to the recording medium without the use of the intermediate transfer member. A belt fixing process may alternatively be employed, in which fixing is performed using a belt.

The toner according to present embodiment is an electrostatic latent image developing toner having a structure described below (referred to below as a basic structure).

(Basic Structure of Toner)

The electrostatic latent image developing toner includes a plurality of toner particles each including a toner core and a shell layer. The shell layer is a collection of a plurality of resin particles having the same composition. Hereinafter, the resin particles serving as a building block of the shell layer (i.e., resin particles having a specific composition) may be referred to as "shell particles". At least 90% by number of the shell particles in the shell layer each have a primary particle diameter of at least 20 nm and no greater than 30 nm. The shell layer includes a first shell layer and a second shell layer. The first shell layer is a film including the shell particles in a non-aggregated state, and the second shell layer is a plurality of particle aggregates. The particle aggregates each include the shell particles in an aggregated state. Hereinafter, the shell particles in the non-aggregated state may be referred to as "monodispersed particles". At least 90% by number of the particle aggregates in the second shell layer each have a secondary particle diameter of at least 100 nm and no greater than 150 nm. The particle aggregates are equivalent to secondary particles, which are each formed through aggregation of a plurality of primary particles. The primary particle diameter of the particle aggregates is equivalent to a diameter of the particles in the non-aggregated state (i.e., primary particles), and the secondary particle diameter of the particle aggregates is equivalent to a diameter of the particle aggregates (i.e., secondary particles) that are each formed of aggregated primary particles. The primary particle diameter and the secondary particle diameter are each a diameter of a representative circle, which is a circle having the same surface area as a projection of a particle measured using a microscope. The surface of the toner core is entirely covered with the shell layer. The second shell layer is present in the surface of each of the toner particles in a proportion of at least 5% by area and no greater than 15% by area. Hereinafter, a proportion of a region, out of an entire surface of each toner core, that is covered with at least one of the first shell layer and the second shell layer in terms of area may be referred to as a first coverage ratio. The proportion (in terms of area) of the second shell layer present in the surface of each toner particle may be referred to as a second coverage ratio.

The first shell layer and the second shell layer in the toner having the above-described basic structure each consist substantially only of a plurality of shell particles (i.e., a plurality of resin particles having the same composition). It is thought that each of the first shell layer and the second shell layer including the shell particles in a proportion of at least 90% by number produces substantially the same action and effect as a shell layer (the first shell layer or the second shell layer) including the shell particles in a proportion of 100% by number.

There is substantially no difference in properties between the monodispersed particles forming the first shell layer and the particle aggregates forming the second shell layer, and thus the former and the latter are compatible. The first shell layer and the second shell layer in the toner having the above-described basic structure therefore have the same charging behavior, reducing abnormal charging of the toner particles. The first shell layer and the second shell layer tend to strongly bond to one another. Particularly preferably, in order to produce the above-described action and effect, the shell layer contains no other resin than a resin forming the shell particles.

The first coverage ratio (unit: %) is represented by an equation: "First coverage ratio=100×(Area of covered region of toner core surface)/(Area of entire toner core surface)". In the equation, the "area of entire toner core surface" is equivalent to a sum of the area of "covered region of toner core surface" and the area of "uncovered region of toner core surface". The "covered region of toner core surface" is equivalent to a region, out of the entire surface of the toner core, that is covered with at least one of the first shell layer and the second shell layer. The "uncovered region of toner core surface" is equivalent to a region, out of the entire surface of the toner core, that is covered neither with the first shell layer nor with the second shell layer.

The second coverage ratio (unit: %) is represented by an equation: "Second coverage ratio=100×(Area of region where second shell layer is present)/(Area of entire surface of toner particle)". In the equation, the "entire surface of toner particle" means an entire surface of the toner particle prior to formation of the second shell layer, that is, an entire surface of the toner core covered with the first shell layer. The "area of entire surface of toner particle" is equivalent to a sum of the area of "region where second shell layer is present" and the area of "region where second shell layer is not present". The "region where second shell layer is not present" is equivalent to a region, out of the entire surface of the toner particle, where the second shell layer (particle aggregates) is not present. The "region where second shell layer is not present" is equivalent to a region, out of the entire surface of the toner core, where the second shell layer (particle aggregates) is not present.

The first coverage ratio and the second coverage ratio are measured by methods to be described for Examples or by alternative methods. The first coverage ratio and the second coverage ratio may be measured after addition of an external additive. The measurement may be performed by avoiding the external additive adhering to the toner mother particle or by removing the external additive from the toner mother particles. Removal of the external additive may be performed through dissolution of the external additive using a solvent (for example, an alkaline solution). Alternatively, removal of the external additive may be performed using an ultrasonic cleaner.

At least 90% by number of the shell particles in the shell layer in the toner having the above-described basic structure each have a primary particle diameter of at least 20 nm and no greater than 30 nm. The majority of the shell particles forming each of the first shell layer and the second shell layer have a sufficiently large particle diameter (primary particle diameter). The surface of the toner core is entirely covered with the shell layer including the first shell layer (i.e., a film of monodispersed particles) and the second shell layer (i.e., particle aggregates). For example, the first shell layer entirely covers the surface of the toner core. Alternatively, the first shell layer does not entirely cover the surface of the toner core, but the second shell layer (i.e., particle aggregates) covers a gap in the first shell layer (more specifically, a region of the surface of the toner core that is not covered with the first shell layer). As a result, the toner having the above-described basic structure tends to have excellent thermal-stress resistance.

At least 90% by number of the particle aggregates in the second shell layer in the toner having the above-described basic structure each have a secondary particle diameter of at least 100 nm and no greater than 150 nm. The majority of the particle aggregates forming the second shell layer have a sufficiently large particle diameter (secondary particle diameter). The second shell layer (i.e., particle aggregates) is present on the first shell layer (or region of the surface of the toner core that is not covered with the first shell layer) in a sufficiently large proportion (second coverage ratio: 5%-15%). It is therefore thought that the second shell layer (i.e., particle aggregates) improves fluidity of the toner. The particle aggregates each tend to be irregular-shaped, rather than spherical, having large projections and recesses in a surface thereof. Accordingly, the particle aggregates forming the second shell layer tend not to detach from the toner particle compared to a common external additive. If having a too large particle diameter (more specifically, secondary particle diameter), however, the particle aggregates tend to detach from the toner particle. If the proportion of the second shell layer present in the surface of each toner particle (i.e., second coverage ratio) is too large, low-temperature fixability of the toner tends to be insufficient.

Figure 2:
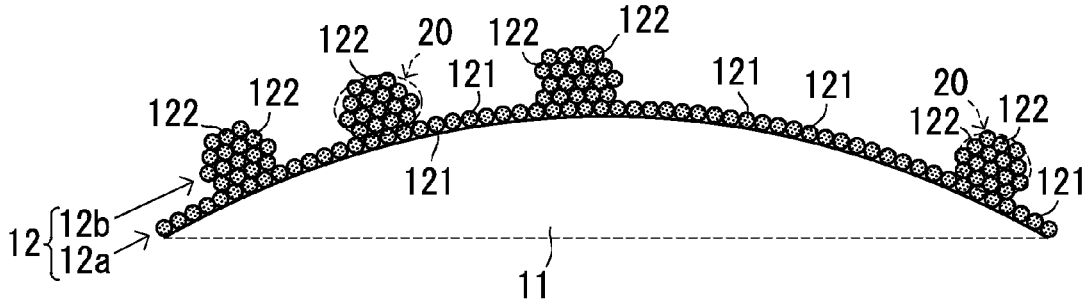
FIG. 2 is a diagram illustrating an example of a cross-section structure of a shell layer of the electrostatic latent image developing toner according to the embodiment of the present disclosure.

The following describes the structure of the toner particles included in the toner having the above-described basic structure with reference to FIGS. 1 and 2. FIG. 1 is a diagram illustrating an example of the structure of each toner particle (particularly a toner mother particle) included in the toner according to the embodiment of the present disclosure. FIG. 2 is an enlarged view of a surface of the toner mother particle.

A toner mother particle 10 illustrated in FIG. 1 includes a toner core 11 and a shell layer 12 covering a surface of the toner core 11. As illustrated in FIG. 2, the shell layer 12 includes a first shell layer 12*a* and a second shell layer 12*b*. More specifically, the first shell layer 12*a* and the second shell layer 12*b* are stacked on the surface of the toner core 11 in the stated order. Preferably, the first shell layer 12*a* covers the surface of the toner core 11 completely (or substantially completely). More specifically, a coverage ratio of the surface of the toner core 11 by the first shell layer 12*a* is at least 95% by area and no greater than 100% by area. The second shell layer 12*b* is present on the first shell layer 12*a* (or region of the surface of the toner core 11 that is not covered with the first shell layer 12*a*). The second shell layer 12*b* is present in the surface of the toner particle (more specifically, surface of the toner core 11 covered with the first shell layer 12*a*) in a proportion of at least 5% by area and no greater than 15% by area.

The first shell layer 12*a* and the second shell layer 12*b* are each a collection of a plurality of shell particles. The shell particles for forming the first shell layer 12*a* are substantially composed of a resin having a specific monomer composition, and the shell particles for forming the second shell layer 12*b* are substantially composed of a resin having the same monomer composition. The first shell layer 12*a* is a film including monodispersed particles 121 (more specifically, the shell particles in a non-aggregated state). The second shell layer 12*b* is a plurality of particle aggregates 20. The particle aggregates 20 each include a plurality of resin particles 122 in an aggregated state. At least 90% by number of the particle aggregates 20 in the second shell layer 12*b* each have a secondary particle diameter of at least 100 nm and no greater than 150 nm. At least 90% by number of the monodispersed particles 121 (i.e., shell particles forming the first shell layer 12*a*) each have a primary particle diameter of at least 20 nm and no greater than 30 nm. At least 90% by number of the resin particles 122 in the aggregated state (i.e., shell particles forming the second shell layer 12*b*) each have a primary particle diameter of at least 20 nm and no greater than 30 nm. The monodispersed particles 121 and the resin particles 122 are composed of the same resin.

FIG. 2 illustrates the particle aggregates 20 each having a substantially spherical shape for the purpose of illustration. In an actual production of the toner having the above-described basic structure, however, the particle aggregates 20 tend to have a more awkward shape than the shape illustrated in FIG. 2 (tend to be irregular-shaped).

Preferably, the shell particles (resin particles forming each of the first shell layer and the second shell layer) are substantially composed of a polymer of a monomer (resin raw material) containing at least one vinyl compound. More preferably, the shell particles are substantially composed of a styrene-acrylic acid-based resin or an acrylic acid-based resin. The polymer of a monomer (resin raw material) containing at least one vinyl compound has a repeating unit derived from a vinyl compound. The vinyl compound refers to a compound having a vinyl group ($CH_2{=}CH{-}$) or a substituted vinyl group in which hydrogen is replaced (specific examples include ethylene, propylene, vinyl chloride, acrylic acid, methyl acrylate, methacrylic acid, methyl methacrylate, acrylonitrile, and styrene). The vinyl compound can be formed into a polymer (resin) by addition polymerization through carbon-to-carbon double bonds "C=C" each included in the vinyl group or the substituted vinyl group.

Particularly preferably, the shell particles contain a resin including a repeating unit having a quaternary ammonium cation (particularly preferably, a repeating unit represented by formula (1) shown below), a repeating unit derived from an acrylic acid-based monomer (particularly preferably, a repeating unit represented by formula (2) shown below), and a repeating unit derived from a styrene-based monomer (particularly preferably, a repeating unit represented by formula (3) shown below.

(1)

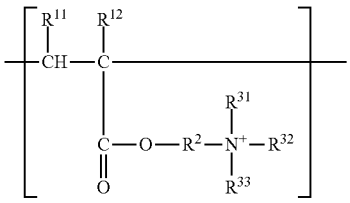

In formula (1), $R^{11}$ and $R^{12}$ each represent, independently of one another, a hydrogen atom, a halogen atom, or an optionally substituted alkyl group. $R^{31}$, $R^{32}$, and $R^{33}$ each represent, independently of one another, a hydrogen atom, an optionally substituted alkyl group, or an optionally substituted alkoxy group. $R^2$ represents an optionally substituted alkylene group. Preferably, $R^{11}$ and $R^{12}$ each represent, independently of one another, a hydrogen atom or a methyl group. Particularly preferably, $R^{11}$ and $R^{12}$ are a combination of $R^{11}$ representing a hydrogen atom and $R^{12}$ representing a hydrogen atom or a methyl group. Preferably, $R^{31}$, $R^{32}$, and $R^{33}$ each represent, independently of one another, an alkyl group having a carbon number of at least 1 and no greater than 8, and particularly preferably a methyl group, an ethyl group, an n-propyl group, an iso-propyl group, an n-butyl group, or an iso-butyl group. $R^2$ preferably represents an alkylene group having a carbon number of at least 1 and no greater than 6, and particularly preferably a methylene group or an ethylene group.

(2)

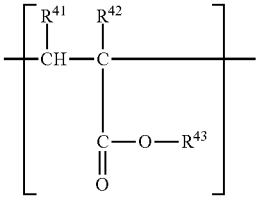

In formula (2), $R^{41}$ and $R^{42}$ each represent, independently of one another, a hydrogen atom, a halogen atom, or an optionally substituted alkyl group. $R^{43}$ represents a hydrogen atom or an optionally substituted alkyl group. $R^{41}$ and $R^{42}$ preferably each represent, independently of one another, a hydrogen atom or a methyl group. Particularly preferably, $R^{41}$ and $R^{42}$ are a combination of $R^{41}$ representing a hydrogen atom and $R^{42}$ representing a hydrogen atom or a methyl group. Particularly preferably, $R^{43}$ represents a hydrogen atom or an alkyl group having a carbon number of at least 1 and no greater than 4. In the repeating unit derived from methyl methacrylate, $R^{41}$ represents a hydrogen atom, and $R^{42}$ and $R^{43}$ each represent a methyl group.

(3)

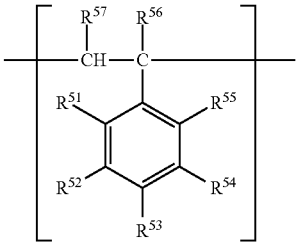

In formula (3), $R^{51}$ to $R^{55}$ each represent, independently of one another, a hydrogen atom, a halogen atom, a hydroxyl group, an optionally substituted alkyl group, an optionally substituted alkoxy group, or an optionally substituted aryl group. $R^{56}$ and $R^{57}$ each represent, independently of one another, a hydrogen atom, a halogen atom, or an optionally substituted alkyl group. Preferably, $R^{51}$ to $R^{55}$ each represent, independently of one another, a hydrogen atom, a halogen atom, an alkyl group having a carbon number of at least 1 and no greater than 4, or an alkoxy group having a carbon number of at least 1 and no greater than 4. $R^{56}$ and $R^{57}$ preferably each represent, independently of one another, a hydrogen atom or a methyl group. Particularly preferably, $R^{56}$ and $R^{57}$ are a combination of $R^{57}$ representing a hydrogen atom and $R^{56}$ representing a hydrogen atom or a methyl group. In the repeating unit derived from styrene, $R^{51}$ to $R^{57}$ each represent a hydrogen atom.

Particularly preferably, in order that the shell layer has sufficiently high hydrophobicity and suitable strength, the shell particles contain a resin including the repeating unit represented by formula (1), the repeating unit represented by formula (2), and the repeating unit represented by formula (3), and a weight percentage of the repeating unit represented by formula (3) is the highest of those of the repeating units included in the resin.

In order to achieve both high-temperature preservability and low-temperature fixability of the toner, the shell particles preferably have a glass transition point (Tg) of at least 58° C. and no greater than 70° C., and a softening point (Tm) of at least 110° C. and no greater than 145° C.

In general, toner cores are broadly classified as being ground cores (referred to also as ground toner) and as being polymerized core (referred to also as chemical toner). Toner cores obtained by a pulverization method are classified as being ground cores. Toner cores obtained by an aggregation method are classified as being polymerized cores. The toner cores of the toner having the above-described basic structure are preferably ground cores containing a polyester resin. Particularly preferably, in order to achieve both high-temperature preservability and low-temperature fixability of the toner, the toner cores therein contain a melt-knead product containing a polyester resin and an internal additive.

Preferably, in order to improve attachment between the toner cores and the shell layers (and thus also strengthen adhesion therebetween) and ensure sufficient fixability of the toner, the toner cores have a composition as described below. The toner cores contains a polyester resin having an acid value of at least 20 mgKOH/g and no greater than 60 mgKOH/g, a hydroxyl value of at least 20 mgKOH/g and no greater than 60 mgKOH/g, a glass transition point of at least 35° C. and no greater than 53° C., a softening point of at least 70° C. and no greater than 100° C., and a zeta potential at pH 4 of at least −50 mV and no greater than −20 mV. The polyester resin contains bisphenol as an alcohol component. The acid value and the hydroxyl value of the polyester resin can be adjusted through adjustment of the amount of the alcohol component and the amount of a carboxylic acid component used during synthesis of the polyester resin.

In order that the toner is suitable for image formation, the toner preferably has a volume median diameter ($D_{50}$) of at least 3 μm and less than 10 μm, and a roundness of at least 0.955 and no greater than 0.975.

The following describes materials suitable for formation of the toner particles. Resins that can be suitably used as a toner core material and a shell material are as follows.

<Suitable Thermoplastic Resins>

Examples of thermoplastic resins that can be preferably used include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohol, vinyl ether resins, N-vinyl resins, polyester resins, polyamide resins, and urethane resins. Furthermore, copolymers of the resins listed above, that is, copolymers obtained through incorporation of a repeating unit into any of the resins listed above (specific examples include styrene-acrylic acid-based resins and styrene-butadiene-based resins) may be used.

A thermoplastic resin is obtained through addition polymerization, copolymerization, or condensation polymerization of at least one thermoplastic monomer. The thermoplastic monomer is a monomer that forms a thermoplastic resin through homopolymarization (specific examples include an acrylic acid-based monomer and a styrene-based monomer) or a monomer that forms a thermoplastic resin through condensation polymerization (specific examples include a combination of a polyhydric alcohol and a polycarboxylic acid that forms a polyester resin through condensation polymerization).

A styrene-acrylic acid-based resin is a copolymer of at least one styrene-based monomer and at least one acrylic acid-based monomer. Examples of styrene-based monomers and acrylic acid-based monomers that can be preferably used for synthesizing the styrene-acrylic acid-based resin are as follows.

Examples of preferable styrene-based monomers include styrene, α-methylstyrene, 4-methylstyrene, 4-ethylstyrene, 4-butylstyrene, 4-methoxy styrene, 3-hydroxy styrene, 4-hydroxy styrene, and halogenated styrene.

Examples of preferable acrylic acid-based monomers include (meth)acrylic acid, (meth)acrylonitrile, alkyl (meth) acrylates, and hydroxyalkyl (meth)acrylates. Examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of preferable hydroxyalkyl (meth)acrylates include 2-hydroxyethyl(meth)acrylate, 3-hydroxypropyl(meth)acrylate, 2-hydroxypropyl(meth)acrylate, and 4-hydroxybutyl(meth)acrylate.

A polyester resin can be obtained through condensation polymerization of at least one polyhydric alcohol and at least one polycarboxylic acid. Examples of alcohols that can be preferably used in synthesis of the polyester resin include dihydric alcohols (specific examples include diols and bisphenols) and tri- or higher-hydric alcohols shown below. Examples of carboxylic acids that can be preferably used in synthesis of the polyester resin include di-, tri-, and higher-basic carboxylic acids shown below.

Examples of preferable diols include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The following describes, in order, the toner cores (a binder resin and internal additives), the shell layer, and external additives. Non-essential components may be omitted in accordance with the intended use of the toner.

[Toner Cores]

(Binder Resin)

Typically, the binder resin is a main component (for example, at least 85% by mass) of the toner cores. Accordingly, properties of the binder resin are thought to have a great influence on overall properties of the toner cores. Properties (specific examples include hydroxyl value, acid value, Tg, and Tm) of the binder resin can be adjusted by using different resins in combination for the binder resin. The toner cores have a higher tendency to be anionic in a situation in which the binder resin has an ester group, a hydroxyl group, an ether group, an acid group, or a methyl group, and have a higher tendency to be cationic in a situation in which the binder resin has an amino group or an amide group.

In order to achieve both high-temperature preservability and low-temperature fixability of the toner, the toner cores preferably contain, as the binder resin, any of the "preferable thermoplastic resins" listed above, and particularly preferably a polyester resin or a styrene-acrylic acid-based resin.

In a situation in which the polyester resin is used as the binder resin of the toner cores, the polyester resin preferably has a number average molecular weight (Mn) of at least 1,000 and no greater than 2,000 in order to improve toner core strength and toner fixability. The polyester resin preferably has a molecular weight distribution (ratio Mw/Mn of mass average molecular weight (Mw) to number average molecular weight (Mn)) of at least 9 and no greater than 21.

In a situation in which the styrene-acrylic acid-based resin is used as the binder resin of the toner cores, the styrene-acrylic acid-based resin preferably has a number average molecular weight (Mn) of at least 2,000 and no greater than 3,000 in order to improve toner core strength and toner fixability. The styrene-acrylic acid-based resin preferably has a molecular weight distribution (ratio Mw/Mn of mass average molecular weight (Mw) to number average molecular weight (Mn)) of at least 10 and no greater than 20.

(Colorant)

The toner cores may contain a colorant. A known pigment or dye matching a color of the toner can be used as a colorant. In order to achieve high quality image formation using the toner, the amount of the colorant is preferably at least 1 part by mass and no greater than 20 parts by mass relative to 100 parts by mass of the binder resin.

The toner cores may contain a black colorant. Carbon black can for example be used as a black colorant. Alternatively, a colorant that is adjusted to a black color using a yellow colorant, a magenta colorant, and a cyan colorant can for example be used as a black colorant.

The toner cores may include a non-black colorant such as a yellow colorant, a magenta colorant, or a cyan colorant.

The yellow colorant that can be used is for example one or more compounds selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

The magenta colorant that can be used is for example one or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example one or more compounds selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may contain a releasing agent. The releasing agent is for example used in order to improve fixability or offset resistance of the toner. In order to increase the anionic strength of the toner cores, the toner cores are preferably prepared using an anionic wax. In order to improve fixability or offset resistance of the toner, the amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block polymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. One releasing agent may be used independently, or two or more releasing agents may be used in combination.

In order to improve compatibility between the binder resin and the releasing agent, a compatibilizer may be added to the toner cores.

(Charge Control Agent)

The toner cores may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased by including a negatively chargeable charge control agent (specific examples include organic metal complexes and chelate compounds) in the toner cores. The cationic strength of the toner cores can be increased by including a positively chargeable charge control agent (specific examples include pyridine, nigrosine, and quaternary ammonium salts) in the toner cores. However, when it is ensured that the toner has sufficient chargeability, the toner cores do not need to contain a charge control agent.

(Magnetic Powder)

The toner cores may contain a magnetic powder. Examples of materials of the magnetic powder that can be preferably used include ferromagnetic metals (specific examples include iron, cobalt, nickel, and alloys of any one or two of the aforementioned metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination.

The magnetic powder is preferably subjected to surface treatment in order to inhibit elution of metal ions (for example, iron ions) from the magnetic powder. In a situation in which the shell layers are formed on the surfaces of the toner cores under acidic conditions, elution of metal ions to the surfaces of the toner cores causes the toner cores to adhere to one another more readily. It is thought that inhibiting elution of metal ions from the magnetic powder thereby inhibits the toner cores from adhering to one another.

[Shell Layer]

The first shell layer and the second shell layer in the toner having the above-described basic structure each consist substantially only of the shell particles (resin particles having a primary particle diameter of at least 20 nm and no greater than 30 nm). Preferably, the shell particles are substantially composed of any of the "preferable thermoplastic resin" listed above. An additive may be dispersed in the resin forming the shell particles.

In order to obtain a toner having excellent chargeability, high-temperature preservability, and low-temperature fixability, the resin forming the shell particles preferably contains at least one repeating unit derived from a (meth) acryloyl group-containing quaternary ammonium compound. Examples of (meth)acryloyl group-containing quaternary ammonium compounds that can be preferably used include (meth)acrylamidoalkyltrimethylammonium salts (specific examples include (3-acrylamidopropyl)trimethylammonium chloride) and (meth)acryloyloxyalkyltrimethylammonium salts (specific examples include 2-(methacryloyloxy)ethyltrimethylammonium chloride).

Examples of preferable resins for forming the shell particles include a copolymer of styrene and butyl (meth) acrylate; a copolymer of styrene and a (meth)acryloyl group-containing quaternary ammonium compound; a homopolymer of a (meth)acryloyl group-containing quaternary ammonium compound; a homopolymer of butyl (meth) acrylate; and a polyester resin.

[External Additive]

An external additive (more specifically, a powder including a plurality of external additive particles) may be caused to adhere to the surfaces of the toner mother particles. Unlike internal additives, the external additive is not to be present inside of the toner mother particles but to be selectively present only on the surfaces of the toner mother particle (surfaces of the toner particles). For example, the toner mother particles (powder) and the external additive (powder) are stirred together, so that the external additive particles are caused to adhere to the surfaces of the toner mother particles. The toner mother particles and the external additive particles do not react with one another and are physically, not chemically, connected to one another. Strength of the connection between the toner mother particles and the external additive particles can be adjusted depending on stirring conditions (specific examples include stirring time and rotational speed for stirring), the particle diameter of the external additive particles, the shape of the external additive particles, and a surface condition of the external additive particles.

The external additive is for example used in order to improve fluidity or handleability of the toner. In order to improve fluidity or handleability of the toner, the amount of the external additive (the total amount of external additives in the case of combination use) is preferably at least 0.5 parts by mass and no greater than 10 parts by mass relative to 100 parts by mass of the toner mother particles. Furthermore, in order to improve fluidity or handleability of the toner, the external additive preferably has a particle diameter of at least 0.005 μm and no greater than 1 μm.

External additive particles are preferably inorganic particles, and particularly preferably silica particles or particles of a metal oxide (specific examples include alumina, titanium oxide, magnesium oxide, zinc oxide, strontium titanate, and barium titanate). Alternatively or additionally, particles of an organic acid compound such as a fatty acid metal salt (specific examples include zinc stearate) or resin particles may be used as the external additive particles. Alternatively or additionally, composite particles, which are particles of a composite of a plurality of materials, may be used as the external additive particles. The external additive particles may be surface-treated. One external additive may be used independently, or a plurality external additives may be used in combination.

[Toner Production Method]

The following describes an example of a method for producing the toner having the above-described basic structure. First, the toner cores, a dispersion containing resin particles (monodispersed particles) having a number average primary particle diameter of at least 20 nm and no greater than 30 nm, and a dispersion containing particle aggregates having a number average secondary particle diameter of at least 100 nm and no greater than 150 nm are prepared. The dispersion containing the monodispersed particles is prepared prior to preparation of the particle aggregates. The dispersion containing the particle aggregates having a number average secondary particle diameter of at least 100 nm and no greater than 150 nm is prepared by aggregating the monodispersed particles in the dispersion. Subsequently, in a liquid containing the toner cores and the monodispersed particles, the first shell layer including the monodispersed particles (resin particles in the non-aggregated state) is formed such that the first shell layer covers at least 95% and no greater than 100% of the area of the surface of each toner core. More specifically, the first shell layer that is formed is a film containing the monodispersed particles having a primary particle diameter of at least 20 nm and no greater than 30 nm in a proportion of at least 90% by number. Subsequently, the particle aggregates are added into the liquid and caused to adhere to the surface of each toner core covered with the film of the monodispersed particles to form the second shell layer. More specifically, the second shell layer that is formed is particle aggregates including particle aggregates having a secondary particle diameter of at least 100 nm and no greater than 150 nm in a proportion of at least 90% by number. In order to form shell layers consisting substantially only of resin particles having a primary particle diameter of at least 20 nm and no greater than 30 nm, a suspension containing resin particles (or particle aggregates) having a sharp particle size distribution (vertical axis: frequency, horizontal axis: particle diameter) is preferably used as a shell material.

The following further describes the method for producing the toner according to the present embodiment based on a more specific example.

(Preparation of Toner Cores)

In order to readily obtain suitable toner cores, the toner cores are preferably prepared by an aggregation method or a pulverization method, and more preferably prepared by a pulverization method.

The following describes an example of the pulverization method. First, a binder resin and an internal additive (for example, at least one of a colorant, a releasing agent, a charge control agent, and a magnetic powder) are mixed. Next, the resultant mixture is melt-kneaded. Next, the resultant melt-kneaded product is pulverized, and the resultant pulverized product is classified. As a result, toner cores having a desired particle diameter are obtained.

The following describes an example of the aggregation method. First, fine particles of a binder resin, a releasing agent, and a colorant are caused to aggregate in an aqueous medium until the particles have a desired particle diameter. Through the above, aggregated particles containing the binder resin, the releasing agent, and the colorant are formed. Next, the resultant aggregated particles are heated to cause components of the aggregated particles to coalesce. As a result, a dispersion of toner cores is obtained. Next, non-essential substances (surfactant and the like) are removed from the dispersion of the toner cores to give the toner cores.

(Formation of First Shell Layer)

An acidic substance (for example, hydrochloric acid) is added into ion exchanged water to prepare a mildly acidic aqueous medium (for example, a pH selected from a range of from 3 to 5). In order to inhibit dissolution or elution of the toner core materials (in particular, the binder resin and the releasing agent) during the formation of the shell layers, the formation of the shell layers is preferably carried out in an aqueous medium. The aqueous medium is a medium in which water is a main component (specific examples include pure water and a liquid mixture of water and a polar medium). The aqueous medium may function as a solvent. Solute may be dissolved in the aqueous medium. The aqueous medium may function as a dispersion medium. Dispersoid may be dispersed in the aqueous medium. Examples of polar media that can be used for the aqueous medium include alcohols (specific examples include methanol and ethanol). The aqueous medium has a boiling point of approximately 100° C.

Next, the toner cores and the first shell material (suspension of the resin particles having a number average primary particle diameter of at least 20 nm and no greater than 30 nm) are added into the pH adjusted aqueous medium. The resin particles contained in the suspension are for example substantially composed of a polymer containing a monomer including at least one vinyl compound (examples include styrene, n-butyl acrylate, and quaternary ammonium salt).

The resin particles (first shell material) adhere to the surface of each toner core in the liquid. In order that the resin particles adhere to the surface of each toner core in a uniform manner, a high degree of dispersion of the toner cores is preferably achieved in the liquid containing the resin particles. In order to achieve a high degree of dispersion of the toner cores in the liquid, a surfactant may be added to the liquid, or the liquid may be stirred using a powerful stirrer (for example, "Hivis Disper Mix", product of PRIMIX Corporation). Examples of surfactants that can be used include sulfate ester salt surfactants, sulfonic acid salt surfactants, phosphate acid ester salt surfactants, and soaps.

Next, the liquid containing the toner cores and the first shell material (resin particles) is heated up to a target temperature (for example, a temperature selected from a range of from 40° C. to 85° C.) at a specific rate (for example, a rate selected from a range of 0.1° C./minute to 3° C./minute). Furthermore, the liquid is maintained at the target temperature under stirring for a specific period of time. However, it is not essential that the liquid is maintained at the target temperature after having been heated to the target temperature (after completion of the heating). The liquid may be cooled shortly after the completion of the heating. Bonding between the toner cores and the first shell material (fixation of the first shell layers) develops while the liquid is maintained at the high temperature (or while the liquid is being heated). As a result, the first shell layer completely (or substantially completely) covering each toner core is formed. The first shell layer is a film composed of the monodispersed particles (resin particles in the non-aggregated state). The amount of the first shell material and conditions of the first shell layer formation (specific examples include the heating rate, the target temperature, and the period of time of maintaining the liquid after completion of the heating) are determined such that the coverage ratio of the surface of each toner core by the first shell layer (first coverage ratio) is at least 95% and no greater than 100%.

(Formation of Second Shell Layer)

Next, the liquid containing the toner cores covered with the first shell layers is cooled to for example room temperature (approximately 25° C.). Next, the second shell material (suspension of the particle aggregates having a number average secondary particle diameter of at least 100 nm and no greater than 150 nm) is added to the liquid. The particle aggregates contained in the suspension are aggregates of the resin particles used as the first shell material. That is, the resin particles used as the first shell material and the particle aggregates used as the second shell material include the same resin.

Next, the liquid containing the second shell material (particle aggregates) and the toner cores covered with the first shell layers is heated up to a target temperature (for example, a temperature selected from a range of from 40° C. to 85° C.) at a specific rate (for example, a rate selected from a range of 0.1° C./minute to 3° C./minute) under stirring. Furthermore, the liquid is maintained at the target temperature under stirring for a specific period of time. However, it is not essential that the liquid is maintained at the target temperature after having been heated to the target temperature (after completion of the heating). The liquid may be cooled shortly after the completion of the heating. Bonding of the second shell material to the first shell layers (or regions of the surfaces of the toner cores that are not covered with the first shell layers) develops while the liquid is maintained at the high temperature (or while the liquid is being heated). Through the above, the surface of each toner core is entirely covered with the shell layer including the first shell layer (a film of the monodispersed particles) and the second shell layer (particle aggregates). As a result, a dispersion of toner mother particles is obtained. The amount of the second shell material and conditions of the second shell layer formation (specific examples include the heating rate, the target temperature, and the period of time of maintaining the liquid after completion of the heating) are determined such that the proportion of the second shell layer present in the surface of each toner particle (second coverage ratio) is at least 5% and no greater than 15%. The particle aggregates forming the second shell layers each have a secondary particle diameter of at least 100 nm and no greater than 150 nm. The particle aggregates forming the second shell layers each consist substantially only of the resin particles having a primary particle diameter of at least 20 nm and no greater than 30 nm.

Next, the dispersion of the toner mother particles is cooled to for example room temperature (approximately 25° C.). Next, the dispersion of the toner mother particles is filtered using for example a Buchner funnel. Through the above, the toner mother particles are separated from the liquid (solid-liquid separation), and thus a wet cake of the toner mother particles is obtained. Next, the wet cake of the toner mother particles is washed. Next, the washed toner mother particles are dried. Next, as necessary, the toner mother particles and an external additive may be mixed using a mixer (for example, an FM mixer, product of Nippon Coke & Engineering Co., Ltd.) to cause the external additive to adhere to the surfaces of the toner mother particles.

Procedures and the order of the processes in the above-described toner production method may be changed as appropriate in accordance with desired structure or properties of the toner. For example, a material (for example, the shell material) may be added to the liquid as a single addition or may be divided up and added to the liquid as a plurality of additions. The toner may be sifted after the external additive addition process. Furthermore, non-essential processes may be omitted. In a situation in which a commercially available product can be used as is as a material, for example, a process of preparing the material can be omitted by using the commercially available product. In a situation in which the reaction for formation of the shell layers proceeds favorably without pH of the liquid being adjusted, the process of adjusting the pH may be omitted. In a situation in which an external additive is not necessary, the external additive addition process may be omitted. In a situation in which an external additive is not caused to adhere to the surfaces of the toner mother particles (i.e., the external additive addition process is omitted), the toner mother particles are equivalent to the toner particles. A prepolymer may be used instead of a monomer as a material for synthesizing a resin as necessary. In order to obtain a specific compound, a salt, an ester, a hydrate, or an anhydride of the compound may be used as a material thereof. Preferably, a large number of the toner particles are formed at the same time in order that the toner can be produced efficiently. Toner particles that are produced at the same time are thought to have substantially the same structure as one another.

Examples

The following describes examples of the present disclosure. Tables 1 to 3 show toners TA-1 to TH (which are each an electrostatic latent image developing toner) according to examples and comparative examples.

TABLE 1

| | Primary particles | | | Particle aggregates | | | |
|---|---|---|---|---|---|---|---|
| Toners | Type | Diameter [nm] | Amount [g] | Type | Diameter [nm] | Amount [g] | Proportion [%] |
| TA-1 | Sa-1 | 20 | 30.0 | Ag-1 | 100 | 11.25 | 5 |
| TA-2 | | | | | | 33.75 | 15 |
| TA-3 | | | | | | 9.00 | 4 |
| TA-4 | | | | | | 36.00 | 16 |
| TA-5 | Sa-1 | 20 | 30.0 | Ag-2 | 150 | 16.50 | 5 |
| TA-6 | | | | | | 49.50 | 15 |
| TA-7 | | | | | | 13.50 | 4 |
| TA-8 | | | | | | 54.00 | 16 |
| TB-1 | Sa-2 | 30 | 45.0 | Ag-5 | 100 | 11.25 | 5 |
| TB-2 | | | | | | 33.75 | 15 |
| TB-3 | | | | | | 9.00 | 4 |
| TB-4 | | | | | | 36.00 | 16 |
| TB-5 | Sa-2 | 30 | 45.0 | Ag-6 | 150 | 16.50 | 5 |
| TB-6 | | | | | | 49.50 | 15 |
| TB-7 | | | | | | 13.50 | 4 |
| TB-8 | | | | | | 54.00 | 16 |
| TC-1 | Sa-3 | 15 | 22.5 | Ag-9 | 100 | 11.25 | 5 |
| TC-2 | Sa-4 | 35 | 52.5 | Ag-10 | 100 | 11.25 | 5 |
| TD-1 | Pes | 20 | 30.0 | Ag-11 | 100 | 11.25 | 5 |
| TD-2 | Ac | 20 | 30.0 | Ag-12 | 100 | 11.25 | 5 |

TABLE 2

| | Primary particles | | | Particle aggregates | | | |
|---|---|---|---|---|---|---|---|
| Toners | Type | Diameter [nm] | Amount [g] | Type | Diameter [nm] | Amount [g] | Proportion [%] |
| TE-1 | Sa-1 | 20 | 30.0 | Ag-3 | 90 | 10.05 | 5 |
| TE-2 | | | | | | 30.30 | 15 |
| TE-3 | | | | | | 8.10 | 4 |
| TE-4 | | | | | | 32.25 | 16 |
| TE-5 | Sa-1 | 20 | 30.0 | Ag-4 | 160 | 18.00 | 5 |
| TE-6 | | | | | | 54.00 | 15 |
| TE-7 | | | | | | 14.25 | 4 |
| TE-8 | | | | | | 57.30 | 16 |
| TF-1 | Sa-2 | 30 | 45.0 | Ag-7 | 90 | 10.05 | 5 |

TABLE 2-continued

| Toners | Primary particles Type | Diameter [nm] | Amount [g] | Particle aggregates Type | Diameter [nm] | Amount [g] | Proportion [%] |
|---|---|---|---|---|---|---|---|
| TF-2 | | | | | | 30.30 | 15 |
| TF-3 | | | | | | 8.10 | 4 |
| TF-4 | | | | | | 32.25 | 16 |
| TF-5 | Sa-2 | 30 | 45.0 | Ag-8 | 160 | 18.00 | 5 |
| TF-6 | | | | | | 54.00 | 15 |
| TF-7 | | | | | | 14.25 | 4 |
| TF-8 | | | | | | 57.30 | 16 |

TABLE 3

| Toners | Primary particles Type | Diameter [nm] | Amount [g] | Large particles Type | Diameter [nm] | Amount [g] | Proportion [%] |
|---|---|---|---|---|---|---|---|
| TG-1 | Sa-1 | 20 | 30.0 | — | — | — | — |
| TG-2 | Sa-2 | 30 | 45.0 | | | | |
| TG-3 | Sa-3 | 15 | 22.5 | | | | |
| TG-4 | Sa-4 | 35 | 52.5 | | | | |
| TH | Sa-1 | 20 | 30.0 | Sa-5 | 100 | 11.25 | 5 |

The following describes, in order, production methods, evaluation methods, and evaluation results of toners TA-1 to TH. In evaluations in which errors may occur, an evaluation value was calculated by calculating the arithmetic mean of an appropriate number of measured values in order to ensure that any errors were sufficiently small.

[Preparation of Materials]

(Preparation Method of Styrene-Acrylic Acid-Based Resin Dispersion Sa-1)

Into a 2-L flask equipped with a thermometer (thermocouple), a nitrogen inlet tube, a stirrer, and a condenser (heat exchanger), 250 g of a solvent (isobutanol), 6 g of 2-(diethylamino)ethyl methacrylate, and 6 g of methyl p-toluenesulfonate were added. Next, the flask contents were stirred and caused to react (quaternization reaction) under a nitrogen atmosphere at 80° C. for 1 hour. Next, 155 g of styrene, 75 g of butyl acrylate, and 12 g of a peroxide polymerization initiator (t-butyl peroxy-2-ethylhexanoate, product of Arkema Yoshitomi, Ltd.) were further added into the flask with nitrogen gas flowing in the flask.

Next, the flask contents were heated to 95° C. (polymerization temperature) and stirred for 3 hours. Next, 12 g of a peroxide polymerization initiator (t-butyl peroxy-2-ethylhexanoate, product of Arkema Yoshitomi, Ltd.) was further added into the flask, and the flask contents were stirred for 3 hours. Next, the flask contents were dried under environmental conditions of a high temperature (140° C.) and a reduced pressure (10 kPa) to remove the solvent. Next, the flask contents were broken up to give a coarsely pulverized product.

Next, the coarsely pulverized product was further pulverized using a mechanical pulverizer ("Turbo Mill T250", product of Freund-Turbo Corporation) under a condition of a set particle diameter of 10 μm to give a finely pulverized product. Next, 100 g of the finely pulverized product, 5.0 g of a cationic surfactant ("QUARTAMIN (registered Japanese trademark) 24P", a 25% by mass aqueous lauryltrimethylammonium chloride solution, product of Kao Corporation), and 25 g of a 0.1N-aqueous sodium hydroxide solution were mixed to give a dispersion.

Next, ion exchanged water was added to the thus obtained dispersion to prepare 400 g of a slurry overall. Next, the slurry was loaded into a stainless steel pressure-resistant round-bottomed vessel. Next, the slurry in the vessel was subjected to shear dispersion using a high-speed shear emulsification device ("CLEARMIX (registered Japanese trademark) CLM-2.2S", product of M Technique Co., Ltd.) for 30 minutes at a rotor rotational speed of 20,000 rpm under environmental conditions of a high temperature (140° C.) and a high pressure (0.5 MPa). Next, the vessel content was stirred at a rotor rotational speed of 15,000 rpm under cooling at a rate of 5° C./minute until the inner temperature of the vessel was 50° C. to give the styrene-acrylic acid-based resin dispersion Sa-1 containing resin particles (particles substantially composed of a styrene-acrylic acid-based resin containing a positively chargeable charge control agent) in a solid concentration of 30% by mass.

(Preparation Method of Styrene-Acrylic Acid-Based Resin Dispersion Sa-2)

The styrene-acrylic acid-based resin dispersion Sa-2 (solid concentration: 30% by mass) was prepared according to substantially the same procedure as the preparation method of the styrene-acrylic acid-based resin dispersion Sa-1 in all aspects other than that the amount of the cationic surfactant (QUARTAMIN 24P) was changed from 5.0 g to 4.4 g.

(Preparation Method of Styrene-Acrylic Acid-Based Resin Dispersion Sa-3)

The styrene-acrylic acid-based resin dispersion Sa-3 (solid concentration: 30% by mass) was prepared according to substantially the same procedure as the preparation method of the styrene-acrylic acid-based resin dispersion Sa-1 in all aspects other than that the amount of the cationic surfactant (QUARTAMIN 24P) was changed from 5.0 g to 5.3 g.

(Preparation Method of Styrene-Acrylic Acid-Based Resin Dispersion Sa-4)

The styrene-acrylic acid-based resin dispersion Sa-4 (solid concentration: 30% by mass) was prepared according to substantially the same procedure as the preparation method of the styrene-acrylic acid-based resin dispersion Sa-1 in all aspects other than that the amount of the cationic surfactant (QUARTAMIN 24P) was changed from 5.0 g to 4.1 g.

(Preparation Method of Styrene-Acrylic Acid-Based Resin Dispersion Sa-5)

The styrene-acrylic acid-based resin dispersion Sa-5 (solid concentration: 30% by mass) was prepared according to substantially the same procedure as the preparation method of the styrene-acrylic acid-based resin dispersion Sa-1 in all aspects other than that the amount of the cationic surfactant (QUARTAMIN 24P) was changed from 5.0 g to 0.3 g.

The resin particles contained in each of the styrene-acrylic acid-based resin dispersions Sa-1 to Sa-5 obtained as described above had a Tg of 60° C. and a Tm of 125° C. The number average particle diameters of the resin particles contained in the styrene-acrylic acid-based resin particles Sa-1, Sa-2, Sa-3, Sa-4, and Sa-5 (solid concentration: 30% by mass) were respectively 20 nm, 30 nm, 15 nm, 35 nm, and 100 nm as shown under the heading "Diameter" in Tables 1 to 3. In each of the styrene-acrylic acid-based resin dispersions Sa-1, Sa-2, Sa-3, Sa-4, and Sa-5, 90% by number or more of the resin particles had a sharp particle size distribution and had the same particle diameter (primary particle diameter) as the number average particle diameter thereof. For example, 90% by number or more of the resin particles contained in the styrene-acrylic acid-based resin dispersion Sa-1 had a primary particle diameter of 20 nm.

(Preparation Method of Polyester Resin Dispersion Pes)

First, 1,300 g of a polyester resin (monomer composition (molar ratio): bisphenol A propylene oxide adduct/bisphenol A ethylene oxide adduct/fumaric acid/trimellitic acid=30/20/44/6) was loaded into a vessel in a mixer equipped with a temperature regulating jacket ("T.K. Hivis Disper Mix HM-3D-5", product of PRIMIX Corporation), and the vessel content was melt-kneaded at a temperature of 120° C. Next, 100 g of triethanolamine and 80 g of a 25% by mass aqueous solution of an anionic surfactant ("Emal (registered Japanese trademark) 0", product of Kao Corporation, component: sodium lauryl sulfate) were added into the vessel, and the vessel contents were kneaded at a planetary rotation speed of 50 rpm for 15 minutes. Next, 2,870 g of ion exchanged water at 98° C. was poured into the vessel at a rate of 50 g/minute to give an emulsion of the polyester resin. Next, the vessel content was cooled at a rate of 5° C./minute until the inner temperature of the vessel was 50° C. to give the polyester resin dispersion Pes containing resin particles (more specifically, particles substantially composed of a polyester resin containing no positively chargeable charge control agent) in a solid concentration of 30% by mass. The resin particles contained in the polyester resin dispersion Pes obtained as described above had a number average particle diameter of 20 nm, a Tg of 59° C., and a Tm of 120° C. In the polyester resin dispersion Pes, 90% by number or more of the resin particles had a sharp particle size distribution and had the same primary particle diameter as the number average particle diameter thereof (that is, had a primary particle diameter of 20 nm).

(Preparation Method of Acrylic Acid-Based Resin Dispersion Ac)

The acrylic acid-based resin dispersion Ac containing resin particles having a number average particle diameter of 20 nm, a Tg of 60° C., and Tm of 123° C. (more specifically, particles substantially composed of an acrylic acid-based resin containing a positively chargeable charge control agent) in a solid concentration of 30% by mass was obtained according to substantially the same procedure as the preparation method of the styrene-acrylic acid-based resin dispersion Sa-1 in all aspects other than that 230 g of butyl acrylate was used instead of 155 g of styrene and 75 g of butyl acrylate. In the acrylic acid-based resin dispersion Ac, 90% by number or more of the resin particles had a sharp particle size distribution and had the same primary particle diameter as the number average particle diameter thereof (that is, had a primary particle diameter of 20 nm).

(Preparation Method of Particle Aggregate Dispersion Ag-1)

Into a 2-L stainless steel round-bottomed flask equipped with a stirring impeller, 640 g of the styrene-acrylic acid-based resin dispersion Sa-1 (solid concentration: 30% by mass) and 500 g of ion exchanged water were added, and the temperature of the flask contents was adjusted to 25° C. The flask content was adjusted to pH 10 through addition of 1N-aqueous sodium hydroxide solution under stirring at a rotational speed of 200 rpm using the stirring impeller. Subsequently, the flask content was stirred at a rotational speed (stirring impeller) of 200 rpm at 25° C. for 10 minutes.

Furthermore, 10 g of an aqueous solution of magnesium chloride hexahydrate (coagulant) having a solid concentration of 50% by mass was dripped into the flask over 5 minutes while the flask content was stirred at a rotational speed (stirring impeller) of 200 rpm at 25° C. Subsequently, the flask content was heated up to 55° C. at a rate of 0.2° C./minute under stirring at a rotational speed (stirring impeller) of 200 rpm and maintained at the same temperature (55° C.) for 5 minutes, thereby promoting aggregation of the particles for granulation and causing coalescence of the aggregated particles. Next, 50 g of a 20% by mass aqueous sodium chloride solution (aggregation terminating agent) was added into the flask as a single addition. Subsequently, the flask content was rapidly cooled to 25° C. at a rate of 10° C./minute to yield the particle aggregate dispersion Ag-1 containing particle aggregates having a number average particle diameter of 100 nm, a Tg of 60° C., and a Tm of 125° C. (more specifically, styrene-acrylic acid-based resin particle aggregates) in a solid concentration of 20% by mass. In the particle aggregate dispersion Ag-1, 90% by number or more of the particle aggregates had a sharp particle size distribution and had the same secondary particle diameter as the number average particle diameter thereof (that is, had a secondary particle diameter of 100 nm).

(Preparation Method of Particle Aggregate Dispersion Ag-2)

The particle aggregate dispersion Ag-2 containing particle aggregates having a number average particle diameter of 150 nm, a Tg of 60° C., and a Tm of 125° C. in a solid concentration of 20% by mass was obtained according to substantially the same procedure as the preparation method of the particle aggregate dispersion Ag-1 in all aspects other than that the period of time of maintaining the flask content at 55° C. was changed from 5 minutes to 10 minutes. In the particle aggregate dispersion Ag-2, 90% by number or more of the particle aggregates had a sharp particle size distribution and had the same secondary particle diameter as the number average particle diameter thereof (that is, had a secondary particle diameter of 150 nm).

(Preparation Method of Particle Aggregate Dispersion Ag-3)

The particle aggregate dispersion Ag-3 containing particle aggregates having a number average particle diameter of 90 nm, a Tg of 60° C., and a Tm of 125° C. in a solid concentration of 20% by mass was obtained according to substantially the same procedure as the preparation method of the particle aggregate dispersion Ag-1 in all aspects other than that the period of time of maintaining the flask content at 55° C. was changed from 5 minutes to 4 minutes. In the particle aggregate dispersion Ag-3, 90% by number or more of the particle aggregates had a sharp particle size distribution and had the same secondary particle diameter as the number average particle diameter thereof (that is, had a secondary particle diameter of 90 nm).

(Preparation Method of Particle Aggregate Dispersion Ag-4)

The particle aggregate dispersion Ag-4 containing particle aggregates having a number average particle diameter of 160 nm, a Tg of 60° C., and a Tm of 125° C. in a solid concentration of 20% by mass was obtained according to substantially the same procedure as the preparation method of the particle aggregate dispersion Ag-1 in all aspects other than that the period of time of maintaining the flask content at 55° C. was changed from 5 minutes to 11 minutes. In the particle aggregate dispersion Ag-4, 90% by number or more of the particle aggregates had a sharp particle size distribution and had the same secondary particle diameter as the number average particle diameter thereof (that is, had a secondary particle diameter of 160 nm).

(Preparation Method of Particle Aggregate Dispersion Ag-5)

The particle aggregate dispersion Ag-5 containing particle aggregates having a number average particle diameter of 100 nm, a Tg of 60° C., and a Tm of 125° C. in a solid concentration of 20% by mass was obtained according to substantially the same procedure as the preparation method of the particle aggregate dispersion Ag-1 in all aspects other than that 640 g of the styrene-acrylic acid-based resin dispersion Sa-2 (solid concentration: 30% by mass) was used instead of 640 g of the styrene-acrylic acid-based resin dispersion Sa-1 (solid concentration: 30% by mass), and the period of time of maintaining the flask content at 55° C. was changed from 5 minutes to 4 minutes. In the particle aggregate dispersion Ag-5, 90% by number or more of the particle aggregates had a sharp particle size distribution and had the same secondary particle diameter as the number average particle diameter thereof (that is, had a secondary particle diameter of 100 nm).

(Preparation Method of Particle Aggregate Dispersion Ag-6)

The particle aggregate dispersion Ag-6 containing particle aggregates having a number average particle diameter of 150 nm, a Tg of 60° C., and a Tm of 125° C. in a solid concentration of 20% by mass was obtained according to substantially the same procedure as the preparation method of the particle aggregate dispersion Ag-5 in all aspects other than that the period of time of maintaining the flask content at 55° C. was changed from 4 minutes to 9 minutes. In the particle aggregate dispersion Ag-6, 90% by number or more of the particle aggregates had a sharp particle size distribution and had the same secondary particle diameter as the number average particle diameter thereof (that is, had a secondary particle diameter of 150 nm).

(Preparation Method of Particle Aggregate Dispersion Ag-7)

The particle aggregate dispersion Ag-7 containing particle aggregates having a number average particle diameter of 90 nm, a Tg of 60° C., and a Tm of 125° C. in a solid concentration of 20% by mass was obtained according to substantially the same procedure as the preparation method of the particle aggregate dispersion Ag-5 in all aspects other than that the period of time of maintaining the flask content at 55° C. was changed from 4 minutes to 3 minutes. In the particle aggregate dispersion Ag-7, 90% by number or more of the particle aggregates had a sharp particle size distribution and had the same secondary particle diameter as the number average particle diameter thereof (that is, had a secondary particle diameter of 90 nm).

(Preparation Method of Particle Aggregate Dispersion Ag-8)

The particle aggregate dispersion Ag-8 containing particle aggregates having a number average particle diameter of 160 nm, a Tg of 60° C., and a Tm of 125° C. in a solid concentration of 20% by mass was obtained according to substantially the same procedure as the preparation method of the particle aggregate dispersion Ag-5 in all aspects other than that the period of time of maintaining the flask content at 55° C. was changed from 4 minutes to 10 minutes. In the particle aggregate dispersion Ag-8, 90% by number or more of the particle aggregates had a sharp particle size distribution and had the same secondary particle diameter as the number average particle diameter thereof (that is, had a secondary particle diameter of 160 nm).

(Preparation Method of Particle Aggregate Dispersion Ag-9)

The particle aggregate dispersion Ag-9 containing particle aggregates having a number average particle diameter of 100 nm, a Tg of 60° C., and a Tm of 125° C. in a solid concentration of 20% by mass was obtained according to substantially the same procedure as the preparation method of the particle aggregate dispersion Ag-1 in all aspects other than that 640 g of the styrene-acrylic acid-based resin dispersion Sa-3 (solid concentration: 30% by mass) was used instead of 640 g of the styrene-acrylic acid-based resin dispersion Sa-1 (solid concentration: 30% by mass), and the period of time of maintaining the flask content at 55° C. was changed from 5 minutes to 5.5 minutes. In the particle aggregate dispersion Ag-9, 90% by number or more of the particle aggregates had a sharp particle size distribution and had the same secondary particle diameter as the number average particle diameter thereof (that is, had a secondary particle diameter of 100 nm).

(Preparation Method of Particle Aggregate Dispersion Ag-10)

The particle aggregate dispersion Ag-10 containing particle aggregates having a number average particle diameter of 100 nm, a Tg of 60° C., and a Tm of 125° C. in a solid concentration of 20% by mass was obtained according to substantially the same procedure as the preparation method of the particle aggregate dispersion Ag-1 in all aspects other than that 640 g of the styrene-acrylic acid-based resin dispersion Sa-4 (solid concentration: 30% by mass) was used instead of 640 g of the styrene-acrylic acid-based resin dispersion Sa-1 (solid concentration: 30% by mass), and the period of time of maintaining the flask content at 55° C. was changed from 5 minutes to 3.5 minutes. In the particle aggregate dispersion Ag-10, 90% by number or more of the particle aggregates had a sharp particle size distribution and had the same secondary particle diameter as the number average particle diameter thereof (that is, had a secondary particle diameter of 100 nm).

(Preparation Method of Particle Aggregate Dispersion Ag-11)

The particle aggregate dispersion Ag-11 containing particle aggregates having a number average particle diameter of 100 nm, a Tg of 59° C., and a Tm of 120° C. in a solid concentration of 20% by mass was obtained according to substantially the same procedure as the preparation method of the particle aggregate dispersion Ag-1 in all aspects other than that 640 g of the polyester resin dispersion Pes (solid concentration: 30% by mass) was used instead of 640 g of the styrene-acrylic acid-based resin dispersion Sa-1 (solid concentration: 30% by mass). In the particle aggregate dispersion Ag-11, 90% by number or more of the particle aggregates had a sharp particle size distribution and had the same secondary particle diameter as the number average particle diameter thereof (that is, had a secondary particle diameter of 100 nm).

(Preparation Method of Particle Aggregate Dispersion Ag-12)

The particle aggregate dispersion Ag-12 containing particle aggregates having a number average particle diameter of 100 nm, a Tg of 60° C., and a Tm of 123° C. in a solid concentration of 20% by mass was obtained according to substantially the same procedure as the preparation method of the particle aggregate dispersion Ag-1 in all aspects other than that 640 g of the acrylic acid-based resin dispersion Ac (solid concentration: 30% by mass) was used instead of 640 g of the styrene-acrylic acid-based resin dispersion Sa-1 (solid concentration: 30% by mass). In the particle aggregate dispersion Ag-12, 90% by number or more of the particle aggregates had a sharp particle size distribution and had the same secondary particle diameter as the number average particle diameter thereof (that is, had a secondary particle diameter of 100 nm).

[Production Methods of Toners TA-1 to TF-8]

(Preparation of Toner Cores)

A polyester resin was synthesized by causing a reaction between bisphenol A ethylene oxide adduct (more specifically, an alcohol produced through addition of ethylene oxide to a bisphenol A framework) and acids having multiple functional groups (more specifically, terephthalic acid and trimellitic anhydride) in the presence of a titanium oxide catalyst. The thus obtained polyester resin had a glass transition point (Tg) of 48° C., a softening point (Tm) of 100° C., an acid value (AV) of 40 mgKOH/g, and a hydroxyl value (OHV) of 20 mgKOH/g.

Next, 100 parts by mass of the polyester resin obtained as described above, 5 parts by mass of a colorant (C.I. Pigment Blue 15:3, ingredient: copper phthalocyanine pigment), and 5 parts by mass of an ester wax ("Nissan Electol (registered Japanese trademark) WEP-3", product of NOF Corporation, melting point: 73° C.) were mixed using a 10-L FM mixer ("FM-10C/I", product of Nippon Coke & Engineering Co., Ltd.).

Next, the resultant mixture was melt-kneaded using a twin-screw extruder ("PCM-30", product of Ikegai Corp.). The kneaded product was subsequently cooled to give chips of the kneaded product. Next, the chips of the kneaded product were pulverized using a mechanical pulverizer ("Turbo Mill T250", product of FREUND-TURBO CORPORATION) under a condition of a set particle diameter of 5.6 μm. Next, the pulverized product was classified using a classifier ("Elbow Jet EJ-LABO", product of Nittetsu Mining Co., Ltd.). The above process yielded toner cores having a volume median diameter ($D_{50}$) of 6.8 μm, a roundness of 0.931, a Tg of 50° C., a Tm of 98° C., a triboelectric charge with the standard carrier of −20 μC/g, and a zeta potential at pH 4 of −20 mV. The triboelectric charge with the standard carrier and the zeta potential at pH 4 were measured as described below.

<Measurement Method of Triboelectric Charge>

A mixer ("TURBULA (registered Japanese trademark) mixer T2F", product of Willy A. Bachofen (WAB) AG) was used to mix 100 parts by mass of a standard carrier N-01 (standard carrier for negative-charging toner) provided by The Imaging Society of Japan and 7 parts by mass of a sample (toner cores) at a rotational speed of 96 rpm for 30 minutes. Next, the triboelectric charge of the sample in the resultant mixture was measured using a Q/m meter ("MODEL 210HS-2A", product of TREK, INC.). More specifically, 0.10 g of the mixture (the standard carrier and the sample) was loaded into a measurement cell of the Q/m meter, and only the sample in the loaded mixture was drawn in through a screen (metal mesh) for 10 seconds. The charge (unit: μC/g) of the sample was calculated based on an expression "total amount of electricity of drawn sample (unit: μC)/mass of drawn sample (unit: g)".

<Measurement Method of Zeta Potential>

A magnetic stirrer was used to mix 0.2 g of the sample (toner cores), 80 g of ion exchanged water, and 20 g of a 1% by mass non-ionic surfactant ("K-85", product of Nippon Shokubai Co., ingredient: polyvinylpyrrolidone). Next, the sample was caused to uniformly disperse in the liquid to yield a dispersion. Next, the dispersion was adjusted to pH 4 through addition of dilute hydrochloric acid. A zeta potential and particle size distribution analyzer ("Delsa Nano HC", product of Beckman Coulter, Inc.) was used to measure the zeta potential of the sample in the dispersion at 25° C. and pH 4 by electrophoresis (more specifically, laser Doppler electrophoresis).

(Formation of First Shell Layer)

A 1-L three-necked flask having a thermometer and a stirring impeller was set up in a water bath, and 300 mL of ion exchanged water was added into the flask. The internal temperature of the flask was maintained at 30° C. using a water bath. Next, the flask content was adjusted to pH 4 through addition of dilute hydrochloric acid.

Next, with respect to each of the toners TA-1 to TF-8, 300 g of the toner cores (toner cores prepared as described above) and a first shell material for the toner in an amount specified under the heading "Primary particles" in Table 1 or 2 (a dispersion for the toner specified under the heading "Primary particles" in Table 1 or 2) were added into the flask, and the flask contents were stirred sufficiently. For example, in the production of the toner TA-1, 30.0 g of the styrene-acrylic acid-based resin dispersion Sa-1 was added as the first shell material. For another example, in the production of the toner TB-1, 45.0 g of the styrene-acrylic acid-based resin dispersion Sa-2 was added as the first shell material. For another example, in the production of the toner TD-1, 30.0 g of the polyester resin dispersion Pes was added as the first shell material. For another example, in the production of the toner TD-2, 30.0 g of the acrylic acid-based resin dispersion Ac was added as the first shell material.

Next, 300 mL of ion exchanged water was added into the flask. The internal temperature of the flask was raised up to 65° C. at a rate of 1° C./minute while the flask contents were stirred at a rotational speed (stirring impeller) of 100 rpm. Once the internal temperature of the flask reached 65° C., the heating was stopped, and the internal temperature of the flask was rapidly cooled to room temperature (approximately 25° C.) at a rate of 10° C./minute. Through the above, the first shell layer was formed on the surface of each toner core. The coverage ratio of the surfaces of the toner cores was 100%.

(Formation of Second Shell Layer)

Next, with respect to each of the toners TA-1 to TF-8, a second shell material for the toner (a dispersion for the toner specified under the heading "Particle aggregates" in Table 1 or 2) in an amount specified under the heading "Particle aggregates" in Table 1 or 2 was added into the flask, and the flask contents were stirred sufficiently. For example, in the production of the toner TA-1, 11.25 g of the particle aggregate dispersion Ag-1 was added as the second shell material. For another example, in the production of the toner TA-5, 16.50 g of the particle aggregate dispersion Ag-2 was added as the second shell material.

Next, 300 mL of ion exchanged water was added into the flask. The internal temperature of the flask was raised up to 65° C. at a rate of 1° C./minute while the flask contents were stirred at a rotational speed (stirring impeller) of 100 rpm. Once the internal temperature of the flask reached 65° C., the heating was stopped, and the internal temperature of the flask was rapidly cooled to room temperature (approximately 25° C.) at a rate of 10° C./minute. Through the above, the second shell layer (particle aggregates) was formed on each first shell layer.

(Washing Process)

After the shell layer formation, the flask contents were adjusted to pH 7 through addition of sodium hydroxide to yield a dispersion of toner mother particles in the flask. The dispersion of the toner mother particles obtained as described above was filtered (solid-liquid separation) using a Buchner funnel to obtain a wet cake of the toner mother particles. Next, the wet cake of the toner mother particles was re-dispersed in ion exchanged water. Dispersion and filtration were repeated six times for washing the toner mother particles.

(Drying Process and External Additive Addition Process)

Next, the washed toner mother particles were dispersed in a 50% by mass aqueous ethanol solution. Through the above, a slurry of the toner mother particles was obtained. Next, a continuous type surface modifier (Coatmizer (registered Japanese trademark), product of Freund Corporation) was used to dry the toner mother particles in the slurry at a hot air temperature of 45° C. and a blower flow rate of 2 $m^3$/minute. During the drying, ethanol containing 0.2 parts by mass of positively chargeable silica particles (silica particles that were made positively chargeable through a surface treatment: "AEROSIL (registered Japanese trademark) REA200", product of Nippon Aerosil Co., Ltd.) was sprayed to 100 parts by mass of the toner mother particles. The spraying caused the external additive (silica particles) to adhere to the surfaces of the toner mother particles. Next, sifting was performed using a 200 mesh sieve (opening 75 μm). As a result, the toner (each of the toners TA-1 to TA-8, TB-1 to TB-8, TC-1 to TC-2, TD-1 to TD-2, TE-1 to TE-8, and TF-1 to TF-8 shown in Tables 1 and 2) containing a large number of toner particles was obtained. The toners TA-1 to F-8 obtained as described above each had a roundness of approximately 0.965 and a volume median diameter ($D_{50}$) of approximately 6.8 μm.

[Production Methods of Toners TG-1 to TG-4]

As shown in Table 3, the toners TG-1, TG-2, TG-3, and TG-4 were produced according to substantially the same procedure as the production method of the toners TA-1, TB-1, TC-1, and TC-2 in all aspects other than that the second shell layer formation process was not performed.

[Production Method of Toner TH]

The toner TH was produced according to substantially the same procedure as the production method of the toner TA-1 in all aspects other than that 11.25 g of the styrene-acrylic acid-based resin dispersion Sa-5 (solid concentration 30% by mass) was used instead of 11.25 g of the particle aggregate dispersion Ag-1 (solid concentration 20% by mass) in the second shell layer formation process.

With respect to each of the toners TA-1 to TH obtained as described above, the proportion of the second shell layers (particle aggregates) present in the surfaces of the toner particles (second coverage ratio) was measured. Tables 1 to 3 show results of the measurement. With respect to the toner TH, however, the proportion of large particles (resin particles having a particle diameter of 100 nm) present in the surfaces of the toner particles is shown. For example, with respect to the toner TA-1, the proportion of the second shell layers present in the surfaces of the toner particles (second coverage ratio) was 5%. With respect to each of the toners TG-1 to TG-4, the toner particles did not have the second shell layers. The proportion of the second shell layers (particle aggregates) present in the surfaces of the toner particles (second coverage ratio) was measured by a method described below.

<Measurement Method of Second Coverage Ratio>

A sample (toner) was dyed in ruthenium. A toner particle in the dyed sample was observed using a field effect scanning electron microscope (FE-SEM) ("JSM-7600F", product of JEOL Ltd.) and a backscattered electron image of the toner particle was captured.

Luminance values of the backscattered electron image were divided into 256 different values by determining a brightest section to have a value of 255 and a darkest section to have a value of 0. Binarization was performed on the backscattered electron image based on an appropriate reference luminance value $S_0$ using image-analyzing software ("WinROOF", product of Mitani Corporation). After the binarization, an area $S_A$ of the whole backscattered electron image (corresponding to the total number of pixels in the backscattered electron image) and an area $S_B$ of regions with luminance values greater than or equal to the reference luminance value $S_0$ in the backscattered electron image (corresponding to the number of pixels with luminance values greater than or equal to the reference luminance value $S_0$ in the backscattered electron image) were determined. The second coverage ratio (unit: %) was calculated in accordance with an equation shown below. An area of each region covered with anything other than the target particles (particle aggregates) was not included in the area $S_B$.

$$\text{Second coverage ratio} = 100 \times \text{Area } S_B / \text{Area } S_A$$

Furthermore, the first coverage ratio of each toner (each of the toners TA-1 to TH) was measured according to substantially the same procedure as the measurement method of the second coverage ratio in all aspects other than that the reference luminance value $S_0$ was changed so that the toner core and the shell layer (the first shell layer and the second shell layer) could be distinguished. All of the toners had a first coverage ratio of 100%. It was evident from visual observation of each backscattered electron image that the surface of the toner core was completely covered with the shell layer (the first shell layer and the second shell layer).

In each of the toners TA-1, TA-2, TA-5, TA-6, TB-1, TB-2, TB-5, TB-6, TD-1, and TD-2, 90% by number or more of the particle aggregates present in the surfaces of the toner particles each had a secondary particle diameter of at least 100 nm and no greater than 150 nm. In each of the toners TA-1, TA-2, TA-5, TA-6, TB-1, TB-2, TB-5, TB-6, TD-1, and TD-2, 90% by number or more of the resin particles forming the first shell layers each had a primary particle diameter of at least 20 nm and no greater than 30 nm, and 90% by number or more of the resin particles forming the second shell layers each had a primary particle diameter of at least 20 nm and no greater than 30 nm.

[Evaluation Method]

Each of the toners (toners TA-1 to TH) was evaluated by methods described below.

(Preparation of Two-Component Developer)

Appropriate amounts of materials (MnO, MgO, $Fe_2O_3$, and SrO) were blended to give 39.7% by mole in terms of MnO, 9.9% by mole in terms of MgO, 49.6% by mole in terms of $Fe_2O_3$, and 0.8% by mole in terms of SrO, and water was added thereto. Next, the resultant mixture was pulverized over 10 hours using a wet ball mill and subsequently mixed. Next, the resultant mixture was dried. Next, the dried mixture was heated at 950° C. for 4 hours.

Next, the heated mixture was pulverized over 24 hours using a wet ball mill to prepare a slurry. Next, drying and granulation of the slurry were performed using a spray dryer. Next, the dried granules were maintained at 1,270° C. for 6 hours in an atmosphere with an oxygen concentration of 2% and subsequently broken up. Next, particle size adjustment was performed to give a powder (number average primary particle diameter 35 μm) of Mn—Mg—Sr ferrite particles (magnetic carrier cores) having a saturation magnetization of 70 $Am^2/kg$ in response to application of a magnetic field at 3,000 ($10^3/4\pi \cdot A/m$).

Next, a polyamide-imide resin (copolymer of trimellitic anhydride and 4,4'-diaminodiphenyl methane) was diluted with methyl ethyl ketone to prepare a resin solution having a solid concentration of 10% by mass. Next, FEP (tetrafluoroethylene-hexafluoropropylene copolymer) was dispersed in the thus obtained resin solution, and silicon oxide was added thereto in an amount of 2% by mass relative to the overall resin amount to give 150 g of a carrier coat liquid in terms of the solids content. A mass ratio of the polyamide-imide resin and the FEP (polyimide-imide resin:FEP) in the thus obtained carrier coat liquid was 2:8.

Next, 10 kg of the magnetic carrier cores (Mn—Mg—Sr ferrite particles) obtained as described above were coated with the carrier coat liquid using a tumbling fluidized bed coater ("SPIRA COTA (registered Japanese trademark) SP-25", product of OKADA SEIKO CO., LTD.). Next, the resin-coated magnetic carrier cores were sintered at 220° C. for 1 hour. Thus, an evaluation carrier was obtained. The carrier was coated at a resin coverage of 3% by mass.

A two-component developer was prepared by using a ball mill to mix 100 parts by mass of the evaluation carrier obtained as described above and 10 parts by mass of a sample (toner) for 30 minutes.

(Minimum Fixable Temperature)

A color multifunction peripheral ("TASKalfa5550ci", product of KYOCERA Document Solutions Inc.) equipped with a fixing device was used as an evaluation apparatus. A surface of a heat roll of the fixing device was made of a PFA (tetrafluoroethylene-perfluoroalkyl vinyl ether copolymer) tube having a thickness of 30 μm±10 μm and a surface roughness (Ra: arithmetic mean roughness) of 5 μm. The two-component developer prepared as described above was loaded into a developing device of the evaluation apparatus, and a sample (toner for replenishment use) was loaded into a toner container of the evaluation apparatus.

The evaluation apparatus was used to form a solid image (more specifically, an unfixed toner image) with a size of 25 cm×25 cm on paper (A4 size printing paper) having a basis weight of 90 $g/m^2$ at a linear speed of 300 mm/second (landscape paper conveyance) and a toner application amount of 15 mg under environmental conditions of 25° C. and 50% RH. Next, the paper on which the image was formed was passed through the fixing device of the evaluation apparatus.

The fixing temperature was set in a range of from 70° C. to 150° C. in the minimum fixable temperature evaluation. More specifically, a minimum temperature at which the solid image (toner image) was fixable to the paper (i.e., a minimum fixable temperature) was measured by increasing the fixing temperature of the fixing device from 70° C. in increments of 5° C. (in increments of 2° C. at temperatures close to the minimum fixable temperature). Determination of whether or not the toner was fixable was carried out through a fold-rubbing test. The fold-rubbing test was performed by folding the evaluation paper having passed through the fixing device such that a surface on which the image was formed was folded inwards, and by rubbing a 1 kg weight covered with cloth back and forth on the fold with the image five times. Next, the paper was opened up and a fold portion (i.e., a portion at which the solid image was formed) was observed. The length of toner peeling of the fold portion (peeling length) was measured. The minimum fixable temperature was determined to be the lowest temperature among temperatures for which the peeling length was no greater than 1 mm. A minimum fixable temperature of no greater than 100° C. was evaluated as good. A minimum fixable temperature of greater than 100° C. was evaluated as poor.

(Fluidity)

An aerated bulk density (A.D.) of each sample (toner) was measured under environmental conditions of 25° C. and 50% RH by a method described below.

A funnel with a 1-mm mesh set therein was placed on a funnel stand which was kept horizontal, and a vessel having a volume of 30 $cm^3$ was placed under the funnel. A sample (toner) in an amount of 40 g was loaded on the mesh. A portion of the toner that passed through the mesh at this point was returned onto the mesh. Next, the toner on the mesh was distributed evenly across the mesh using a brush, and the entirety of the toner was caused to drop into the vessel over 90 seconds. The toner dropped into the vessel under the funnel through the mesh. After 40 g of the toner had dropped, the vessel was heaped. The excess toner (toner that went beyond the brim of the vessel) was scraped away using a scraper, so that an open face of the vessel was horizontal. Next, the mass of the toner in the vessel (unit: g) was measured, and the aerated bulk density (unit: $g/cm^3$) of the sample (toner) was determined in accordance with an equation shown below.

$$\text{Aerated bulk density} = \text{Mass of toner in vessel}/30\ cm^3$$

The measurement was performed twice for each sample, and an arithmetic mean of the two measurement values obtained was determined as an evaluation value (aerated bulk density) of the sample (toner). An evaluation value (aerated bulk density) of 0.30 $g/cm^3$ or greater was evaluated as good. An evaluation value (aerated bulk density) of less than 0.30 $g/cm^3$ was evaluated as poor.

(Thermal-Stress Resistance)

Figure 3:
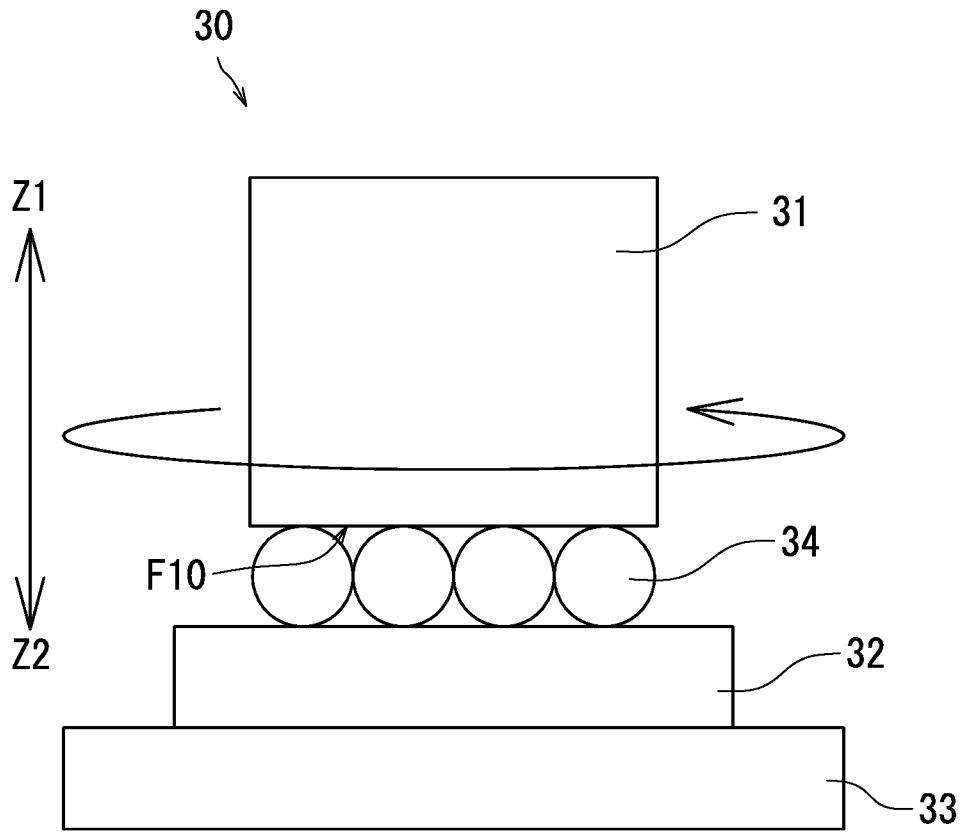
FIG. 3 is a diagram for illustrating a method for evaluating thermal-stress resistance.

A rheometer ("MCR-301", product of Anton Paar GmbH) was used as an evaluation apparatus. FIG. 3 is a schematic illustration of the evaluation apparatus (rheometer). The following describes a method for evaluating thermal-stress resistance with reference to FIG. 3.

As illustrated in FIG. 3, an evaluation apparatus 30 includes an aluminum indenter 31, a stainless steel (SUS) plate 32, and a heater 33. The indenter 31 is in a cylindrical shape with a bottom surface F10 having an area of 0.785 $cm^2$. The plate 32 is fixed. The indenter 31 is driven to move by a motor. A distance between the bottom surface F10 of the indenter 31 and a top surface of the plate 32 changes with movement of the indenter 31 in a direction (Z direction) perpendicular to the top surface of the plate 32. A specified pressure can be applied to toner particles 34 by causing the indenter 31 to approach the plate 32 (move in a Z2 direction) with the toner particles 34 placed between the bottom surface F10 of the indenter 31 and the top surface of the plate 32. The indenter 31 is also driven by the motor to rotate about its rotation axis, which is a Z axis.

In the thermal-stress resistance evaluation, the toner particles 34 were heated at a rate of 2° C./minute while a constant pressing load was being applied onto the toner particles 34 by the indenter 31 rotating in 0.01° rotation angle increments at a frequency of 1 Hz. A pressing load of 3.0 N/cm$^2$ (constant) was applied onto the toner particles 34, and a temperature at which the rotational torque of the indenter 31 was 5 mN·m was measured. The rotational torque tends to increase to be 5 mN·m or greater once the toner particles start melting and tends to start decreasing once the toner particles have melted to a certain degree. The thermal-stress resistance was evaluated as good if the temperature at which the rotational torque was 5 mN·m was 60° C. or greater. The thermal-stress resistance was evaluated as poor if the temperature at which the rotational torque was 5 mN·m was less than 60° C.

[Evaluation Results]

Tables 4 and 5 show results of the evaluations of the low-temperature fixability (minimum fixable temperature), the fluidity (aerated bulk density), and the thermal-stress resistance (temperature at which the rotational torque was 5 mN·m) with respect to the toners TA-1 to TH.

TABLE 4

| | Toners | Minimum fixable temperature | Fluidity | Thermal-stress resistance |
|---|---|---|---|---|
| Example 1 | TA-1 | Good | Good | Good |
| Example 2 | TA-2 | Good | Good | Good |
| Example 3 | TA-5 | Good | Good | Good |
| Example 4 | TA-6 | Good | Good | Good |
| Example 5 | TB-1 | Good | Good | Good |
| Example 6 | TB-2 | Good | Good | Good |
| Example 7 | TB-5 | Good | Good | Good |
| Example 8 | TB-6 | Good | Good | Good |
| Example 9 | TD-1 | Good | Good | Good |
| Example 10 | TD-2 | Good | Good | Good |

TABLE 5

| | Toners | Minimum fixable temperature | Fluidity | Thermal-stress resistance |
|---|---|---|---|---|
| Comparative Example 1 | TA-3 | Poor | Good | Good |
| Comparative Example 2 | TA-4 | Good | Poor | Good |
| Comparative Example 3 | TA-7 | Poor | Good | Good |
| Comparative Example 4 | TA-8 | Good | Poor | Good |
| Comparative Example 5 | TB-3 | Poor | Good | Good |
| Comparative Example 6 | TB-4 | Good | Poor | Good |
| Comparative Example 7 | TB-7 | Poor | Good | Good |
| Comparative Example 8 | TB-8 | Good | Poor | Good |
| Comparative Example 9 | TC-1 | Good | Good | Poor |
| Comparative Example 10 | TC-2 | Good | Poor | Good |
| Comparative Example 11 | TE-1 | Poor | Good | Good |
| Comparative Example 12 | TE-2 | Poor | Good | Good |
| Comparative Example 13 | TE-3 | Poor | Good | Good |
| Comparative Example 14 | TE-4 | Good | Poor | Good |
| Comparative Example 15 | TE-5 | Poor | Good | Good |
| Comparative Example 16 | TE-6 | Poor | Good | Good |
| Comparative Example 17 | TE-7 | Poor | Good | Good |
| Comparative Example 18 | TE-8 | Good | Poor | Good |
| Comparative Example 19 | TF-1 | Poor | Good | Good |
| Comparative Example 20 | TF-2 | Poor | Good | Good |
| Comparative Example 21 | TF-3 | Poor | Good | Good |
| Comparative Example 22 | TF-4 | Good | Poor | Good |

TABLE 5-continued

| | Toners | Minimum fixable temperature | Fluidity | Thermal-stress resistance |
|---|---|---|---|---|
| Comparative Example 23 | TF-5 | Poor | Good | Good |
| Comparative Example 24 | TF-6 | Poor | Good | Good |
| Comparative Example 25 | TF-7 | Poor | Good | Good |
| Comparative Example 26 | TF-8 | Good | Poor | Good |
| Comparative Example 27 | TG-1 | Poor | Good | Good |
| Comparative Example 28 | TG-2 | Poor | Good | Good |
| Comparative Example 29 | TG-3 | Poor | Good | Poor |
| Comparative Example 30 | TG-4 | Poor | Poor | Good |
| Comparative Example 31 | TH | Poor | Good | Good |

The toners TA-1, TA-2, TA-5, TA-6, TB-1, TB-2, TB-5, TB-6, TD-1, and TD-2 (toners according to Examples 1 to 10) each had the above-described basic structure.

More specifically, each of the toners according to Examples 1 to 10 contained the toner particles each including the toner core, the first shell layer, and the second shell layer. The first shell layer was a film composed of a plurality of monodispersed particles (i.e., resin particles in the non-aggregated state). The second shell layer was a plurality of particle aggregates (i.e. resin particles in the aggregated state). The first shell layer and the second shell layer were each a collection of a plurality of resin particles having the same composition. In the production of each of the toners according to Examples 1 to 10, a particle aggregate dispersion for second shell layer formation was prepared using a dispersion used for forming the first shell layer (i.e., film of monodispersed particles).

In each of the toners according to Examples 1 to 10, 90% by number or more of the resin particles in the shell layers each had a primary particle diameter of at least 20 nm and no greater than 30 nm. In the second shell layers, 90% by number or more of the particle aggregates each had a secondary particle diameter of at least 100 nm and no greater than 150 nm. The surface of each toner core was entirely covered with the shell layer including the first shell layer and the second shell layer. More specifically, the first shell layer entirely covered the surface of the toner core. The proportion of the second shell layers present in the surfaces of the toner particles was at least 5% by area and no greater than 15% by area (see Table 1).

As shown in Table 4, each of the toners according to Examples 1 to 10 was excellent in thermal-stress resistance, low-temperature fixability, and fluidity.

What is claimed is:

1. An electrostatic latent image developing toner comprising a plurality of toner particles each including a core and a shell layer covering a surface of the core, wherein the shell layer is a collection of a plurality of resin particles having the same composition, at least 90% by number of the resin particles in the shell layer each have a primary particle diameter of at least 20 nm and no greater than 30 nm, the shell layer includes a first shell layer and a second shell layer, the first shell layer being a film including the resin particles in a non-aggregated state, the second shell layer being a plurality of particle aggregates, the particle aggregates each include the resin particles in an aggregated state, at least 90% by number of the particle aggregates in the second shell layer each have a secondary particle diameter of at least 100 nm and no greater than 150 nm, the surface of the core is entirely covered with the shell layer, and the second shell layer is present in a surface of the toner particle in a proportion of at least 5% by area and no greater than 15% by area.

2. The electrostatic latent image developing toner according to claim 1, wherein a coverage ratio of the surface of the core by the first shell layer is at least 95% by area and no greater than 100% by area.

3. The electrostatic latent image developing toner according to claim 1, wherein the resin particles in the shell layer contain a styrene-acrylic acid-based resin.

4. The electrostatic latent image developing toner according to claim 1, wherein the resin particles in the shell layer contain an acrylic acid-based resin.

5. The electrostatic latent image developing toner according to claim 1, wherein the resin particles in the shell layer contain a resin including a repeating unit represented by formula (1) shown below, a repeating unit represented by formula (2) shown below, and a repeating unit represented by formula (3) shown below, (1)

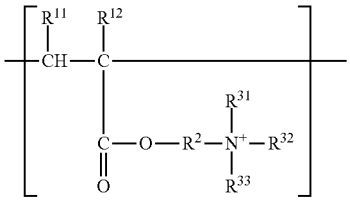

where in formula (1), $R^{11}$ and $R^{12}$ each represent, independently of one another, a hydrogen atom or a methyl group, $R^{31}$, $R^{32}$, and $R^{33}$ each represent, independently of one another, an alkyl group having a carbon number of at least 1 and no greater than 8, and $R^2$ represents an alkylene group having a carbon number of at least 1 and no greater than 6, (2)

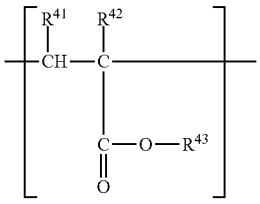

in formula (2), $R^{41}$ and $R^{42}$ each represent, independently of one another, a hydrogen atom or a methyl group, and $R^{43}$ represents a hydrogen atom or an alkyl group having a carbon number of at least 1 and no greater than 4, and (3)

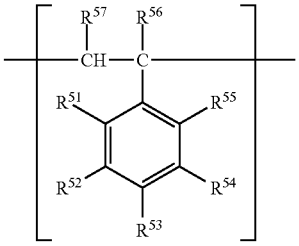

in formula (3), $R^{51}$ to $R^{55}$ each represent, independently of one another, a hydrogen atom, a halogen atom, an alkyl group having a carbon number of at least 1 and no greater than 4, or an alkoxy group having a carbon number of at least 1 and no greater than 4, and $R^{56}$ and $R^{57}$ each represent, independently of one another, a hydrogen atom or a methyl group.

6. The electrostatic latent image developing toner according to claim 5, wherein a weight percentage of the repeating unit represented by formula (3) is the highest of those of the repeating units included in the resin contained in the resin particles.

7. The electrostatic latent image developing toner according to claim 1, wherein the resin particles in the shell layer contain a polyester resin.

8. The electrostatic latent image developing toner according to claim 1, wherein each of the resin particles in the shell layer has a glass transition point of at least 58° C. and no greater than 70° C., and a softening point of at least 110° C. and no greater than 145° C.

9. The electrostatic latent image developing toner according to claim 1, wherein the shell layer contains no other resin than a resin forming the resin particles.

* * * * *